US009685714B2

(12) United States Patent
Milyakh et al.

(10) Patent No.: US 9,685,714 B2
(45) Date of Patent: Jun. 20, 2017

(54) RADAR ARRAY ANTENNA

(71) Applicant: ACE TECHNOLOGIES CORPORATION, Incheon (KR)

(72) Inventors: Yaroslav Milyakh, Incheon (KR); Hak-kyoun Kim, Seoul (KR); Da Young Sun, Jeollanam-do (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 23 days.

(21) Appl. No.: 14/377,826

(22) PCT Filed: Feb. 8, 2013

(86) PCT No.: PCT/KR2013/001044
§ 371 (c)(1),
(2) Date: Aug. 8, 2014

(87) PCT Pub. No.: WO2013/119079
PCT Pub. Date: Aug. 15, 2013

(65) Prior Publication Data

US 2015/0054712 A1 Feb. 26, 2015

(30) Foreign Application Priority Data

Feb. 9, 2012 (KR) ..... 10-2012-0013408

(51) Int. Cl.

| | |
|---|---|
| ***H01Q 1/38*** | (2006.01) |
| ***H01Q 21/29*** | (2006.01) |
| ***H01Q 1/32*** | (2006.01) |
| ***H01Q 21/00*** | (2006.01) |
| ***H01Q 21/06*** | (2006.01) |
| ***H01Q 21/08*** | (2006.01) |

(52) U.S. Cl.
CPC ..... *H01Q 21/293* (2013.01); *H01Q 1/3233* (2013.01); *H01Q 21/0075* (2013.01); *H01Q 21/065* (2013.01); *H01Q 21/08* (2013.01)

(58) Field of Classification Search
CPC ..... H01Q 21/065; H01Q 21/0075
USPC ..... 343/700 MS
See application file for complete search history.

(56) References Cited

U.S. PATENT DOCUMENTS 6,140,965 A 10/2000 Van Hoozen

FOREIGN PATENT DOCUMENTS

| | | |
|---|---|---|
| CN | 101640316 A | 2/2010 |
| CN | 101841083 A | 9/2010 |
| JP | 08-186436 | 7/1996 |
| JP | 10-2000-0065777 | 11/2000 |
| JP | 2001-044752 | 2/2001 |
| JP | 2010-220008 | 9/2010 |
| WO | 98/27616 | 6/1998 |

*Primary Examiner* — Graham Smith
(74) *Attorney, Agent, or Firm* — TechLaw LLP

(57) ABSTRACT

Disclosed is a radar array antenna. The radar array antenna includes: at least one main power feed line electrically coupled to a feed point; a plurality of branch lines branched from the main feed line; and a plurality of patch radiators, each having a square shape, and respectively coupled to the plurality of branch lines. Each of the plurality of branch lines is coupled to one edge of each of the patch radiators. According to the disclosed radar array antenna, the power feed line of the radar array antenna may be minimized in size by using the patch radiator to reduce power losses and realize miniaturization.

5 Claims, 4 Drawing Sheets

- PRIOR ART -

- PRIOR ART -

(a)

(b)

RADAR ARRAY ANTENNA

CROSS-REFERENCE TO RELATED APPLICATIONS

This application is a National Phase Application of PCT International Application No. PCT/KR2013/001044, which was filed on Feb. 8, 2013, and which claims priority from Korean Patent Application No. 10-2012-0013408 filed with the Korean Intellectual Property Office on Feb. 9, 2012. The disclosures of the above patent applications are incorporated herein by reference in their entirety.

BACKGROUND

1. Technical Field Embodiments of the present invention relate to a radar array antenna.

2. Description of the Related Art

A radar is a device that detects the distance and direction of a remote object or target and information on the surroundings of the target by sending beam signals to the target to receive and analyze the reflected waves.

A radar utilizes the linear directionality and reflective characteristics of radio waves, enabling detection unaffected by darkness, rain, snow, and other circumstances that may reduce visibility, and in recent times, radar devices are also being used in automotive vehicles for gathering various information.

While various types of antennas may be used for a radar antenna, one type of antenna commonly used is the array antenna having a microstrip patch.

The array antenna using a microstrip patch may include a main feed line and several branch lines that branch out from the main feed line, with a microstrip patch joined to each of the multiple branch lines.

FIG. 1 illustrates a microstrip patch radar antenna which uses multiple branch lines that branch out from a main feed line according to the related art.

Referring to FIG. 1, a microstrip patch radar antenna using branched lines according to the related art may include a main feed line 100, a multiple number of branch lines 102, and a multiple number of patch radiators 104, and the patch radar antenna illustrated in FIG. 1 can be formed on a dielectric substrate.

The main feed line 100 may be electromagnetically coupled with a feed point, so that a feed signal may be provided to the main feed line 100.

The feed signal provided to the main feed line may branch through the multiple branch lines 102 to be provided to the multiple patch radiators 104. The multiple branch lines 102 allow suitable amounts of power to be provided to the patch radiators 104, and the power provided from the main feed line 100 to each patch radiator 104 can be adjusted based on the width of the branch line 102.

In the case of a radar array antenna used for detection in a vehicle, etc., a polarization of +45 degrees or −45 degrees may be required, and the polarization of the radar array antenna may be determined by the angle in which the patch radiators are placed.

In a conventional radar array antenna, the joining may be implemented at a middle portion of one side of each patch radiator 104, similar to the feeding structure of a typical patch radiator. Also, to provide a polarization of +45 degrees or −45 degrees, the patch radiators may be placed at +45 degrees or −45 degrees with respect to the main feed line 100.

The branch line 102 that connects the main feed line 100 with the patch radiator 104 is one of the major causes of loss and preferably should have a minimized length. However, in the conventional radar array antenna, the branch line 102 is joined to a middle portion on one side of the patch radiator, and thus the length is not effectively minimized.

SUMMARY

An aspect of the invention proposes a radar array antenna using patch radiators with which the size of the feed lines can be minimized.

Also, an aspect of the invention proposes a radar array antenna that can reduce losses.

Also, an aspect of the invention proposes a radar array antenna having a smaller size.

To achieve the objectives above, an embodiment of the invention provides a radar array antenna that includes: at least one main feed line electromagnetically joined with a feed point; a multiple number of branch lines branching from the main feed line; and a multiple number of patch radiators that are joined respectively with the multiple branch lines and have a quadrilateral shape, where each of the plurality of branch lines is joined respectively to a corner portion of the patch radiator.

A multiple number of slots may be formed in the patch radiator.

It may be advantageous for the multiple number of slots to have a rectangular form and be oriented at an angle of +45 degrees or −45 degrees with respect to the main feed line along a lengthwise direction.

Another aspect of the invention provides a radar array antenna that includes: at least one main feed line electromagnetically joined with a feed point; a multiple number of branch lines branching from the main feed line; and a multiple number of patch radiators that are joined respectively with the multiple branch lines and have a quadrilateral shape, where a multiple number of slots that are oriented at an angle of +45 degrees or −45 degrees with respect to the main feed line along a lengthwise direction are formed in the patch radiator.

According to certain embodiments of the invention, the size of the feed lines can be minimized, losses can be reduced, and a smaller size can be provided for a radar array antenna using patch radiators.

Additional aspects and advantages of the present invention will be set forth in part in the description which follows, and in part will be obvious from the description, or may be learned by practice of the invention.

DETAILED DESCRIPTION

Figure 1:
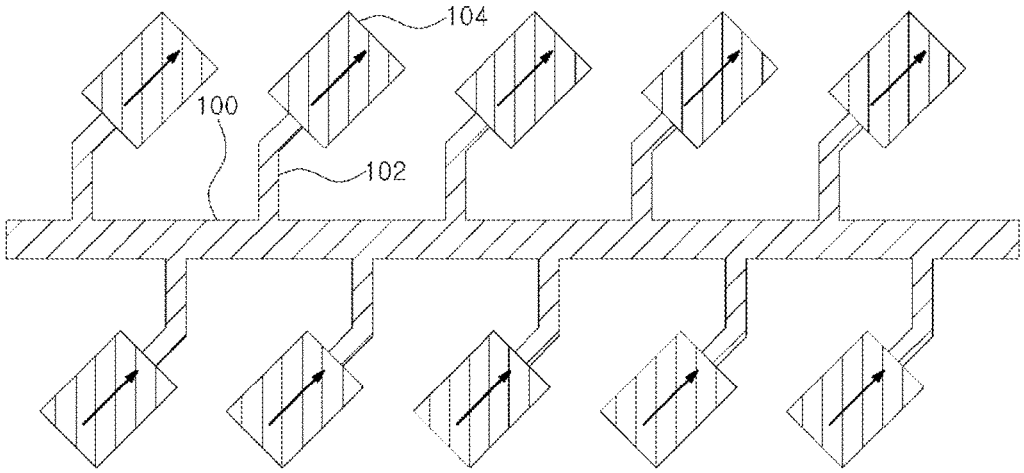
FIG. 1 illustrates a microstrip patch radar antenna using multiple branch lines that branch out from a main feed line according to the related art.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

Certain embodiments of the invention will be described below in more detail with reference to the accompanying drawings.

Figure 2:
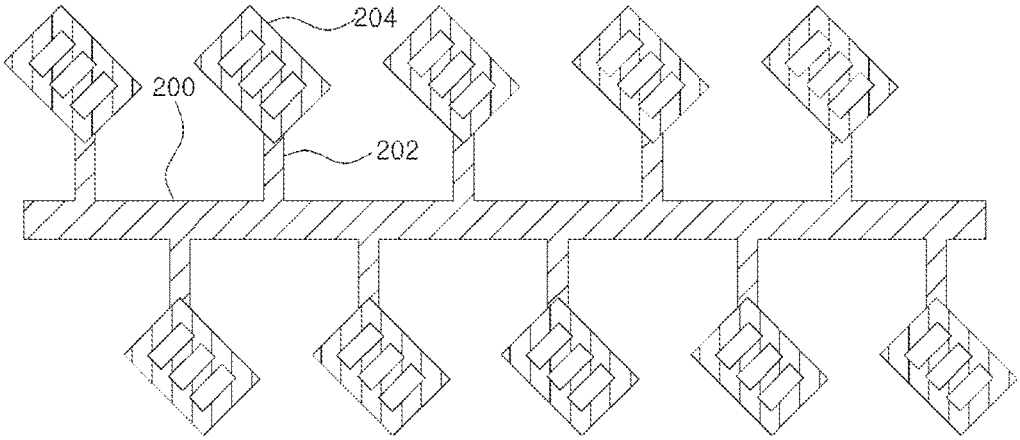
FIG. 2 illustrates the structure of a radar array antenna according to an embodiment of the invention.

FIG. 2 illustrates the structure of a radar array antenna according to an embodiment of the invention.

Referring to FIG. 2, a radar array antenna according to an embodiment of the invention can include a main feed line 200, branch lines 202, and patch radiators 204.

The radar array antenna illustrated in FIG. 2 can be formed over a dielectric substrate, where a ground plane can be formed on the opposite surface of the dielectric substrate on which the radar array antenna is formed.

Referring to FIG. 2, the main feed line 200 may be electromagnetically joined with a feed point, so that a feed signal may be provided to the main feed line 200. In FIG. 2, the feeding structure by which a feed to the main feed line 200 is implemented is omitted, but it would be apparent to those of ordinary skill in the art that various feeding structures can be applied.

Multiple branch lines 202 may branch out from the left and right of the main feed line, where a patch radiator 204 may be joined to each of the multiple branch lines 202 to form an overall array structure.

The multiple branch lines 202 allow suitable amounts of power to be provided to the patch radiators, and the power provided from the main feed line 200 to each patch radiator 204 can be adjusted based on the width of the branch line. As shown in FIG. 2, the multiple branch lines 202 may branch out from the main feed line 200 in perpendicular directions.

The patch radiators 204 may have a quadrilateral shape, and the multiple patch radiators 204 may have an arrayed structure. Each of the patch radiators 204 may serve to radiate and receive signals, where the frequency of the radiated and received signals may be determined by the size of the patch radiator 204.

Although FIG. 2 shows an example in which five patch radiators 204 are joined on either side of the main feed line 200 so that a total of ten patch radiators are joined, the number of patch radiators 204 can be changed as needed.

According to an embodiment of the invention, each of the multiple branch lines 202 may be joined to a corner portion of a quadrilaterally shaped patch radiator 204. Whereas a conventional radar antenna may be structured such that each branch line is joined to a middle portion of a side of the respective patch radiator, an embodiment of the invention may have the branch lines 202 joined to the corner portions of the patch radiators 204.

By joining the branch lines 202 to the corner portions of the patch radiators 204, the lengths of the branch lines 202 can be shortened, making it possible to reduce losses by the branch lines 202, and allowing the reduction in the lengths of the branch lines 202 to provide a smaller size overall.

Figure 3:
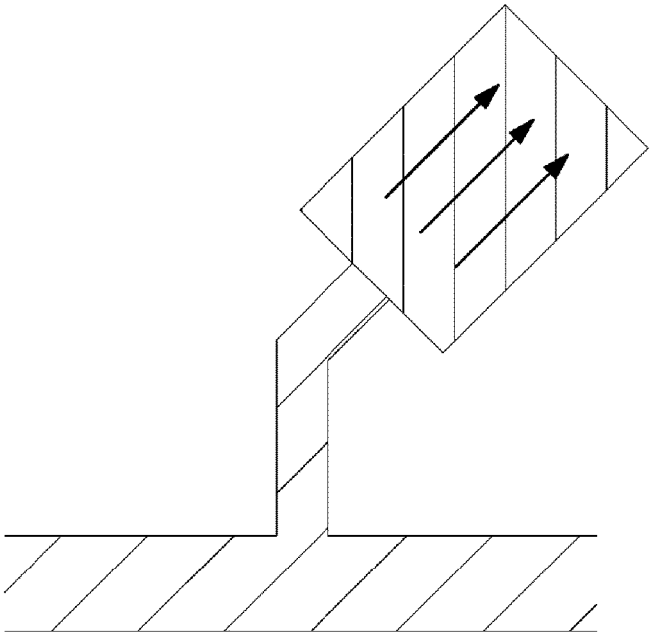
FIG. 3 illustrates the flow of a current in a patch radiator in a radar array antenna according to the related art.

The polarization of the patch radiators 204 may be determined by the direction of the current flowing from the feed portions to the end portions of the patch radiators. FIG. 3 illustrates the flow of a current in a patch radiator in a radar array antenna according to the related art. A conventional radiator such as that shown in FIG. 3 may have the branch lines joined to the middle portions on the sides of the patch radiators and may have the radiators tilted at a 45-degree angle with respect to the main feed line, resulting in a current distribution such as that shown in FIG. 3 and making it possible to provide a 45-degree polarization.

However, a radar array antenna according to an embodiment of the invention, such as that shown in FIG. 2, may have the branch lines joined to the corner portions of the patch radiators, so that the current distribution of FIG. 3 is not obtained, which means that the polarization of the patch radiators 204 is not at a 45-degree angle with respect to the main feed line.

In order to provide a 45-degree polarization even with the branch lines joined at the corners, a patch radiator according to an embodiment of the invention may have a multiple number of slots 250 formed therein. The slots may preferably have a rectangular form and may be formed with an angle of +45 degrees or −45 degrees with respect to the main feed line along their lengthwise directions. The number of slots 250 can be suitably changed according to the sizes of the patch radiators.

Figure 4:
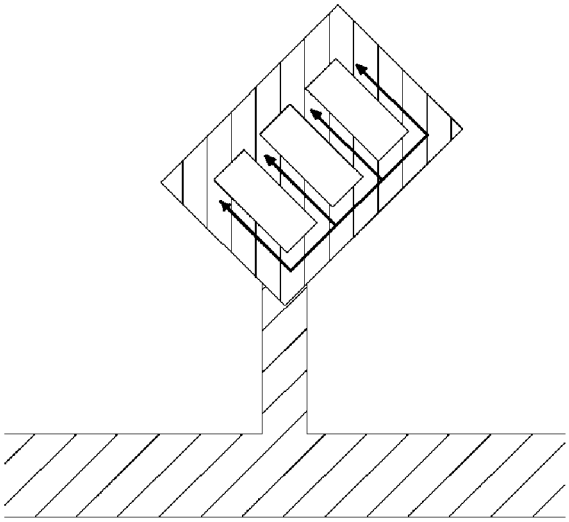
FIG. 4 illustrates the paths of a current formed in a patch radiator in an antenna based on an embodiment of the invention.
Figure 4:
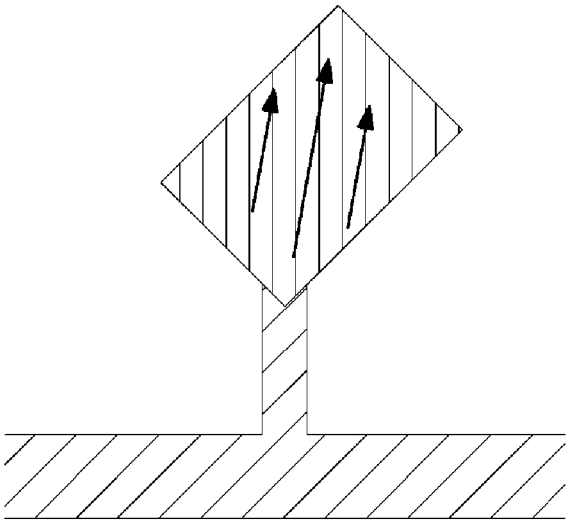

FIG. 4 illustrates the paths of a current formed in a patch radiator in an antenna based on an embodiment of the invention.

In FIG. 4, drawing (a) shows the path of a current when slots are formed in the patch radiator as in an embodiment of the invention, while drawing (b) shows the path of a current when slots are not formed in the patch radiator.

In the case shown in drawing (b) of FIG. 4 where slots are not formed, the path of the current may be formed from the corner where the branch line is joined to the corner furthest away, so that the angle thus formed may be neither +45 degrees nor −45 degrees with respect to the main feed line.

However, in the case shown in drawing (a) of FIG. 4 where slots are formed and the slots are at an angle of +45 degrees or −45 degrees with respect to the main feed line along their lengthwise directions, a current may be formed with the same angle as the direction of the slots. Of course, the present invention is not limited to an angle of 45 degrees for the angle of the slots, and other slot angles can be used if a polarization of another angle is needed.

Figure 5:
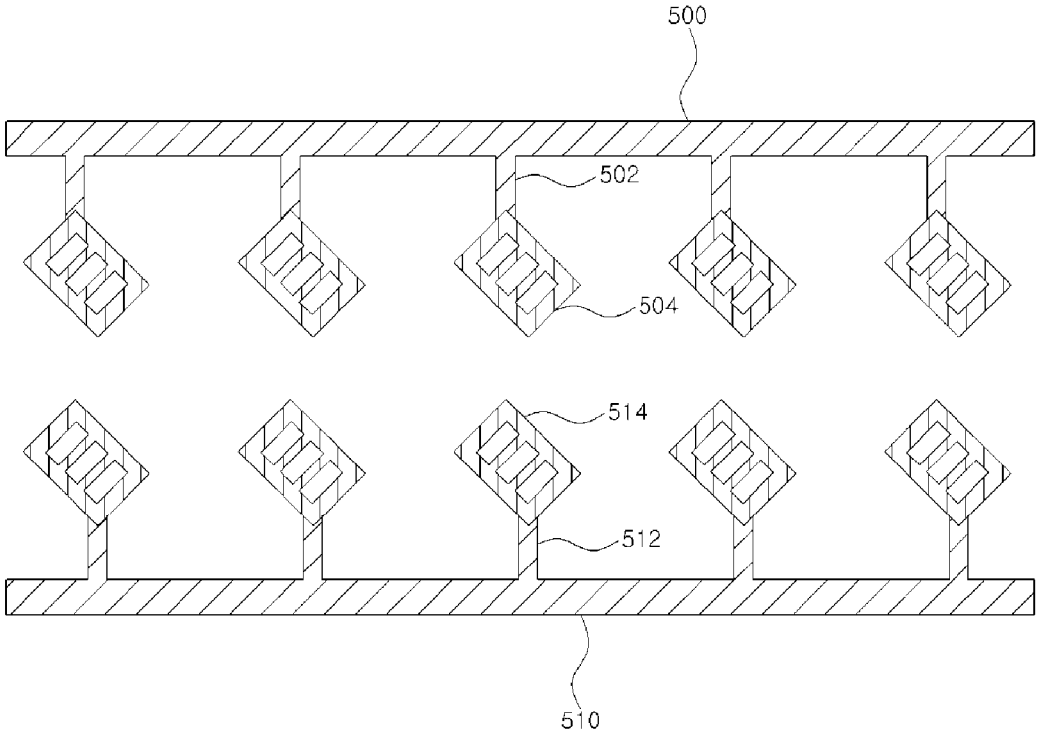
FIG. 5 illustrates a radar array antenna according to another embodiment of the invention.

FIG. 5 illustrates a radar array antenna according to another embodiment of the invention.

Referring to FIG. 5, a radar array antenna according to another embodiment of the invention may include a first main feed line 500, a multiple number of first branch lines 502, a multiple number of first patch radiators 504, a second main feed line 510, a multiple number of second branch lines 512, and a multiple number of second patch radiators 514.

The embodiment shown in FIG. 5 illustrates an example in which the patch radiators are joined to multiple main feed lines.

As illustrated in FIG. 5, the patch radiators according to an embodiment of the invention that has the branch lines joined to the corner portions and has multiple slots formed therein can also be applied to a radar array antenna having multiple main feed lines 500, 510.

The embodiment illustrated in FIG. 5 is an example in which two main feed lines 500, 510 are applied with the patch radiators 504, 514 of an embodiment of the invention, and unlike the embodiment shown in FIG. 2, the branch lines 502, 512 are structured to branch out in only one direction from each main feed line.

A radar antenna based on an embodiment of the invention is not to be constrained in terms of the number of main feed lines or branch lines and can be employed for various uses such as for detection in vehicles, ships, and the like.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A radar array antenna comprising:

at least one main feed line electromagnetically joined with a feed point;

a plurality of branch lines branching from the main feed line; and a plurality of patch radiators joined respectively with the plurality of branch lines, the boundaries of patch radiators having a quadrilateral shape, wherein each of the plurality of branch lines is joined respectively to a first corner portion of the patch radiator, wherein the patch radiator has a plurality of slots formed therein, wherein at least one of the slots is formed between the first corner portion and a second corner portion of the patch radiator, and the second corner portion is located in the diagonal direction from the first corner portion, and wherein the path of a current is formed between the slots.

2. The radar array antenna of claim 1, wherein the plurality of slots have a rectangular form and are oriented at an angle of +45 degrees or −45 degrees with respect to the main feed line along a lengthwise direction.

3. A radar array antenna comprising:

at least one main feed line electromagnetically joined with a feed point;

a plurality of branch lines branching from the main feed line; and a plurality of patch radiators joined respectively with the plurality of branch lines, the boundaries of patch radiators having a quadrilateral shape, wherein the patch radiator has a plurality of slots formed therein, the plurality of slots oriented at an angle of +45 degrees or −45 degrees with respect to the main feed line along a lengthwise direction, and wherein at least one of the slots is formed between a first corner portion and a second corner portion of the patch radiator, and the second corner portion is located in the diagonal direction from the first corner portion, and wherein the path of a current is formed between the slots.

4. The radar array antenna of claim 3, wherein each of the plurality of branch lines is joined respectively to the first corner portion of the patch radiator.

5. The radar array antenna of claim 3, wherein the slots have a rectangular form.

* * * * *